United States Patent [19]

Otsuka

[11] Patent Number: 4,697,313

[45] Date of Patent: Oct. 6, 1987

[54] TACK BUTTON

[75] Inventor: Koji Otsuka, Kitamoto, Japan

[73] Assignee: Scovill Japan Kabushiki Kaisha, Tokyo, Japan

[21] Appl. No.: 848,884

[22] Filed: Apr. 7, 1986

[30] Foreign Application Priority Data

Apr. 30, 1985 [JP] Japan ..... 60-63180[U]

[51] Int. Cl.[4] ..... A44B 1/42

[52] U.S. Cl. ..... 24/95; 24/94; 24/108; 24/687

[58] Field of Search ..... 24/95, 94, 107, 108, 24/92, 687, 689, 96, 113 MP

[56] References Cited

U.S. PATENT DOCUMENTS

| | | | |
|---|---|---|---|
| 465,271 | 12/1891 | Hyde | 24/94 |
| 496,357 | 4/1893 | Hall | 24/95 |
| 539,225 | 5/1895 | Hyde | 24/95 |
| 1,417,646 | 5/1922 | White | 24/95 |
| 2,903,766 | 9/1959 | Fotiades | 24/95 X |
| 3,745,613 | 7/1973 | Daddona | 24/95 X |
| 4,457,050 | 7/1984 | Kanzaka | 24/108 |
| 4,541,148 | 9/1985 | Watanabe | 24/108 |

*Primary Examiner*—Kenneth J. Dorner
*Assistant Examiner*—Laurie K. Cranmer
*Attorney, Agent, or Firm*—Panitch Schwarze Jacobs and Nadel

[57] ABSTRACT

A button body of a tack button comprises a back member, a front member, and a backing core fitted securely in a space formed between the two members, the back member has a plurality of projections formed on the side in contact with the core. The projections are formed either directly on the back member or downwardly in a reinforcing groove formed in the member.

3 Claims, 4 Drawing Figures

TACK BUTTON

BACKGROUND OF THE INVENTION

This invention relates to a tack button, and more specifically to a structure for securely fixing in place a backing core fitted within the button body of a tack button.

Generally, tack buttons comprise a button body and a backing tack piece. The button body, in turn, is made up of a front member constituting the face of the button, a back member with means for receiving and locking the shank of the tack piece, and a backing core to deform the protruding end of the tack piece shaft on clinching. For the fabrication of the button body, the backing core is fitted into a space formed between the front and back members so as to receive the protruding end of the tack piece. The core is then fixed in place between the two members crimped together at the edges. If the crimping force applied is insufficient, a slight gap may be left between the backing core and the front member or the back member. The gap can cause the core to slide or shake inside the button body when the button is subjected to some external force. When this happens, the core hits against the front or back member or both to clink.

If the crimping force is increased sufficiently to preclude this possibility, the backing core is pressed so strongly against the front member that the latter will be marked by the contour of the underlying core, with a consequent reduction in its marketable value. Increasing the crimping force in this manner is impracticable for buttons with embossed patterns on the surface. In view of these, it has been necessary to adjust the applicable crimping force delicately by types of buttons, with difficulties involved in attaining proper crimping individually.

For enhanced strength or rigidity of the back member, some existing tack buttons use a back member formed with a circular reinforcing groove protruding at the bottom on the side in contact with the backing core. The reinforcing groove is rigid enough to remain practically undeformed elastically by weak crimping forces. In order that the backing core be fixed securely within the button body it is essential to increase the crimping force to press the reinforcing groove against the backing core to effect the elastic deformation of the groove. The application of the increased force, however, leads to the unwanted marking of the front member with the underlying core, as noted already.

SUMMARY OF THE INVENTION

The present invention is aimed at overcoming the afore-described difficulties associated with the button bodies of conventional tack buttons.

According to the present invention, a backing core fitted in the space between front and back members is securely fixed in place by crimping with a proper force applied which varies with buttons, maintaining the integrality of the core with the front and back members. There is no possibility of the backing core being pressed with excessive force against the front member to emboss the latter undesirably.

The invention thus provides a tack button high in marketable value, since the backing core is firmly set in place by the application of a proper force and the button so obtained is unimpaired in appearance and free from any unwanted clink in use.

In conformity with the invention, a plurality of downward projections to contact a backing core are formed at the bottom 11 of a reinforcing groove 9 in the back member 4 of the button body of a tack button. During the fabrication of the button body the projections come in contact with the core and are then elastically deformed as the peripheral edge 7 of the front member and the edge 5 of the back member are crimped together, whereby the core is securely fixed in place within the button body.

DETAILED DESCRIPTION OF THE PREFERRED EMBODIMENT

The present invention will now be described in detail with reference to the accompanying drawings.

Figure 1:
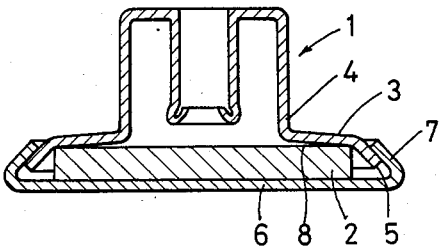
Fig. 1 PRIOR ART
FIG. 1 is a sectional view of the button body of a conventional tack button.
Figure 2:
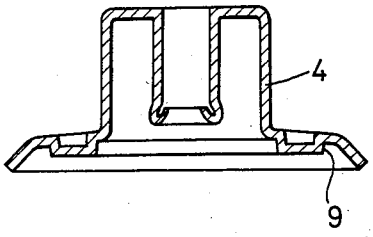
Fig. 2 PRIOR ART
FIG. 2 is a sectional view of the back member of a conventional button body having a reinforcing groove.

FIGS. 1 and 2 illustrate typical button bodies of conventional tack buttons. Referring specifically to FIG. 1, the button body 1 is made up of a backing core 2, a back member 4 having a flat inner surface 3 in contact with the core 2, and a front member 6, the two members 4, 6 enclosing the core 2 in a space formed thereby and are crimped together at their peripheral edges 5, 7, respectively. To avoid leaving any mark of the underlying core 2 on the front member 6, the crimping force applied is not always strong enough to secure the core firmly in place. Thus, when the crimping force is insufficient, a gap 8 is formed between the inner surface 3 of the back member 4 and the core 2. External forces then can cause the core 2 to move or shake with clinks between the back and front members.

In FIG. 2 the back member 4 has a circular reinforcing groove 9 with the bottom protruding downwardly from the inner side of the member toward the core. The groove 9 is not elastically deformed by a weak crimping force, however, and is unable to press the core 2 with an adequate force against the front member so as to secure the core in place.

Figure 3:
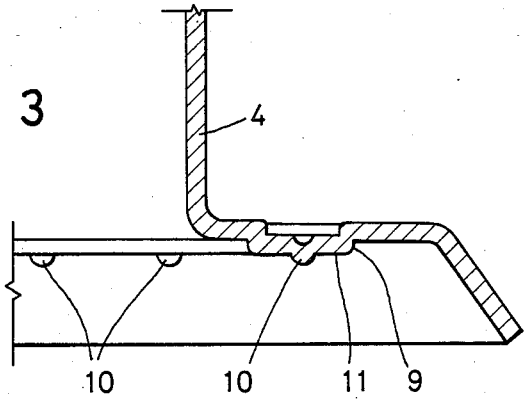
FIG. 3 is a fragmentary sectional view, on an enlarged scale, of the back member of a button body having projections formed along the centerline of a reinforcing groove formed in the member.
Figure 4:
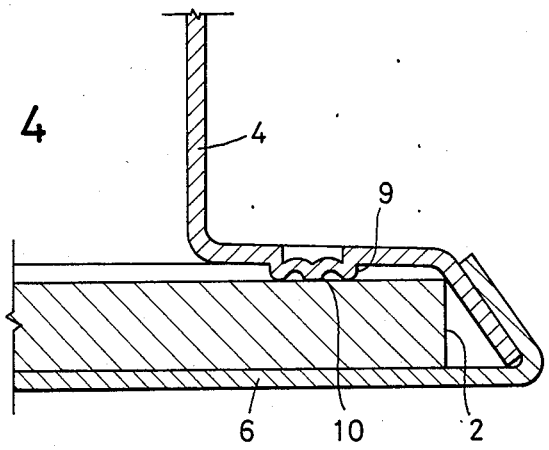
FIG. 4 is a fragmentary sectional view, on an enlarged scale, of a button body as fabricated using the back member of FIG. 3.

FIGS. 3 and 4 show a back member 4 formed with projections in accordance with the present invention. In FIG. 3 the back member 4 has a circular reinforcing groove 9 with the bottom protruding downwardly from the inner side of the member toward the core 2. A plurality of projections 10 are formed along the centerline, and beyond the bottom, of the groove 9. As the back and front members 4, 6 are mated and crimped together at the edges, the projections 10 are forced against the core 2 and crushed at their extremities and then the supporting base of the projections 10, or the bottom surface 11 of the reinforcing groove 9, is slightly forced back or elastically deformed. The repulsive force thus produced in the bottom surface of the groove is strong enough to secure the core 2 in place within the button body, even when the two members have been crimped together with a rather inadequate force.

The projections 10 according to the invention function as effectively when formed on a back member having no such reinforcing groove 9.

While the present invention has been described in connection with a preferred embodiment thereof, it should be noted that the invention may be variously embodied without departing from the spirit of the invention.

What is claimed is:

1. A button body of a tack button comprising a back member having a peripheral edge, a front member having a peripheral edge directly secured to and in contact with the peripheral edge of the back member, and a backing core fitted securely in a space formed between the two members, said back member having a continuous annular reinforcing groove portion forming a complete circle having an annular bottom surface facing the core and a plurality of projections formed on the bottom surface and held elastically in contact with said core.

2. A button body according to claim 1 wherein said annular bottom surface of said groove portion has a width sufficient to be flexed to allow the projections to resiliently hold said backing core against the front member.

3. A button body according to claim 2 wherein the annular bottom surface is substantially flat.

* * * * *